US005586015A

United States Patent [19]

Baldwin et al.

[11] Patent Number: 5,586,015

[45] Date of Patent: Dec. 17, 1996

[54] SPORTS LIGHTING LUMINAIRE HAVING LOW GLARE CHARACTERISTICS

[75] Inventors: Samuel L. Baldwin, E. Flat Rock; William D. Freytag, Hendersonville; Mitchell M. Osteen, Zirconia, all of N.C.

[73] Assignee: General Electric Company, Schenectady, N.Y.

[21] Appl. No.: 79,663

[22] Filed: Jun. 18, 1993

[51] Int. Cl.[6] ..... F21K 7/00

[52] U.S. Cl. ..... 362/263; 362/293; 362/294; 362/305; 362/374

[58] Field of Search ..... 362/226, 254, 362/261–265, 221, 222, 223, 293, 310, 342, 370, 371, 374, 375, 346, 347, 294, 350, 16, 18, 285, 418

[56] References Cited

U.S. PATENT DOCUMENTS

| | | | |
|---|---|---|---|
| 721,646 | 2/1903 | Kirby, Jr. | 362/261 |
| 1,027,306 | 5/1912 | Avery | 362/310 |
| 2,997,574 | 8/1961 | Miskella | 362/264 |
| 3,659,092 | 4/1972 | Dayton et al. | 362/264 |
| 3,661,685 | 5/1972 | Osteen | 362/263 |
| 3,754,134 | 8/1973 | Levin | 362/285 |
| 3,826,913 | 7/1974 | Downing et al. | 362/348 |
| 4,120,023 | 10/1978 | McReynolds, Jr. | 362/16 |
| 4,164,784 | 8/1979 | Jaksich | 362/371 |
| 4,293,901 | 10/1981 | Hernandez | 362/346 |
| 4,420,801 | 12/1983 | Reiling et al. | 362/347 |
| 4,612,475 | 9/1986 | Downing | 313/640 |
| 4,864,476 | 9/1989 | Lemons et al. | 362/297 |
| 4,926,299 | 5/1990 | Gilson | 362/184 |
| 5,143,445 | 9/1992 | Bateman et al. | 362/293 |
| 5,177,396 | 1/1993 | Gielen et al. | 362/293 |

*Primary Examiner*—Denise L. Gromada
*Assistant Examiner*—Alan B. Cariaso
*Attorney, Agent, or Firm*—George E. Hawranko

[57] ABSTRACT

A sports lighting fixture having improved light delivery characteristics includes an elongated bare arc tube, high intensity discharge lamp disposed near the apex of a parabolically shaped reflector member. The reflector is constructed of a non-metallic material and by the orientation and positioning of the lamp within the reflector, an essentially oval shaped light pattern is generated. A light transmissive cover is disposed over the open end of the reflector. When projected onto the playing surface of a sports field, the oval shaped light pattern translates to an essentially circular shaped pattern which allows for a more uniform and efficient overlapping of the multiple light outputs at the playing field level. Louvers can be disposed within the reflector to further redirect any high angle light output into a lower angle which is more useful at the playing surface level.

19 Claims, 6 Drawing Sheets

SPORTS LIGHTING LUMINAIRE HAVING LOW GLARE CHARACTERISTICS

FIELD OF THE INVENTION

This invention relates to a sports lighting luminaire having low glare lighting characteristics. More specifically, this invention relates to such a sports lighting luminaire as exhibits improved photometric performance so as to achieve a more efficient and uniform light delivery configuration to a large area such as a playing surface of a sports field or arena.

BACKGROUND OF THE INVENTION

In the past, when architectural lighting designers were faced with the task of uniformly illuminating the playing surface of a sports field while minimizing the amount of light spilled into the seating portion of the sports field, the individual lighting fixtures at their disposal would be of a type that utilized such light delivery techniques as glare shields and louvers. The aim of such a designer is to substantially reduce or even eliminate the amount of light that extends above the playing surface and into the eyes of the spectators and even above the confines of the field so as to adversely affect the surrounding homes and/or businesses. It is known that though such glare shields and louvers can be effective to direct light output in a desired pattern, in doing so, these devices contribute a measurable amount of light loss that therefore requires an increased amount of light output from the light source. In addition to resulting in light loss, a typical sports lighting fixture provides such shield and louver devices in an external manner to the reflector portion so as to adversely contribute to the wind loading characteristics of such light fixture. An example of a light fixture having external glare shield and louver elements is found in U.S. Pat. No. 4,725,934 issued to Gordon on Feb. 16, 1988. Given that each louver results in a specific amount of light loss and that external light directing elements increase wind loading of the fixture, it would therefore be advantageous that if further light directing elements were needed to direct light output so as to minimize spill light above the necessary playing surface, that the number of such devices be minimized and that they reside within the reflector configuration rather than on the outside thereof.

The number of louvers that are needed to redirect light output is directly related to how large of an upper light output angle there is relative to the longitudinal axis of the reflector of the fixture. The larger the angle of light output from the reflector, the greater the amount of louver area is needed to redirect such light to the specific location desired. As seen it the previously cited U.S. Pat. No. 4,725,934, the reflector portion is essentially elliptical in shape and as such results in a large output angle of light as it exits the reflector. It should also be noted that in such fixture, the light source is disposed on the longitudinal axis of the reflector thereby resulting in light being generated near the outer edge of the reflector. The disposition of the light source in this manner is required because of the size of the outer jacket of the light source, however, it is known that such an orientation of the light source relative to the reflector results in a large angle of light output. It would therefore be advantageous if a light source, reflector orientation could be provided that resulted in as collimated a light output from the reflector as possible so as to achieve a minimum spread of light output falling at large angles relative to the longitudinal axis of the reflector.

Toward the goal of maximizing the amount of light output from an individual reflector that can be utilized on the playing surface, it is also known that the reflector portion of the fixture is typically constructed of aluminum which is polished so as to achieve a high reflectivity value. The use of aluminum reflectors is well known for sports lighting fixtures. One of the disadvantages however with an aluminum reflector is the fact that the reflectivity is such that only about 75–85% of the light generated by the light source is actually reflected by such aluminum reflector out of the fixture. Additionally, if a bare quartz arc tube light source is utilized in conjunction with an aluminum or other metallic reflector in a manner to be in close proximity to the metallic reflector, it has been observed that photons emitted by the light source strike the reflector and result in electrons bouncing back at the quartz material which has the effect of degrading the quartz material of the arc tube. If a light source is rated having a life of over 3000 hours, such degradation of the arc tube material will be sufficient to cause early failure of the light source. Accordingly, it would be further advantageous if a reflector, light source arrangement could be achieved which would have a reflectivity value of about 95% and would not cause the degradation of the quartz arc tube of the light source. As an example of a commercially available sports lighting fixture using an aluminum reflector and a bare quartz arc tube light source can be found in the product designated "ArenaVision" which is available from Philips Lighting.

Yet another problem encountered by the lighting designer of a sports field is the determination of the optimum combination of fixtures and the tilt of such fixtures so as to achieve as efficient and uniform of a pattern of illumination as possible. More particularly, since the light pattern at the playing field surface is actually made up of a combination of a number of light output patterns from the various lighting fixtures located along the periphery of the sports field, it is necessary to combine such light outputs in a manner to minimize the number of fixtures needed for the task. In conventional practice, the light output pattern of an individual reflector is circular so that, once it is projected downward and at an angle from the mast structure on which the fixture is mounted, the light pattern at the playing field surface is essentially elliptical with the highest intensity of light output occurring at the foci closest to the fixture. For a discussion of the development of the above referenced ArenaVision sports lighting fixture, reference is made to the paper delivered at the June 1988 IES Annual Conference by Entrop and Verbeek of Philips Lighting entitled "System Oriented Development of Sports Lighting Equipment to Cover New Trends". In this paper, there is significant discussion of the use of a discharge light source which achieves an essentially point source arc configuration. By such reliance on a point source of light, it can be seen that the ArenaVision sports lighting fixture will generate a circular light pattern as measured in a conventional photometric manner thus resulting in the essentially elliptically shaped pattern at the playing field surface. In puzzling together a combination of such elliptical shaped lighting patterns, the lighting designer invariably experiences an inefficient overlapping configuration of the light output at the field surface and will also experience spill light which extends beyond the playing field surface and into the eyes of the spectators. It would therefore be very beneficial if a sports lighting fixture could provide a light output pattern which when projected at an angle downward and away from such fixture would result in a light pattern at the playing field surface that would lend itself to a more efficient overlapping configuration and result in less light spill above such field surface.

SUMMARY OF THE INVENTION

The present invention provides a sports lighting luminaire having low glare characteristics to thereby allow the lighting designer greater flexibility in achieving a lighting pattern at a playing field surface that greatly reduces the amount of spill light extending upward into the spectators eyes and possibly beyond the sports field into surrounding residences or businesses. This is achieved by the fact that this invention provides a sharp beam cutoff at large upper angles without the need for a large number of louvers and without the need for disposing the reduced number of louvers externally of the fixture. Moreover, this invention provides for an orientation between a parabolically shaped reflector and the light source that achieves an oval-shaped beam pattern by tightly controlling the vertical light distribution and loosely controlling light distribution in the horizontal plane. The oval shaped output beam pattern then translates to a circular beam pattern at the playing field surface that allows for a more efficient and uniform overlapping scheme between the beam patterns of the multiple sports lighting fixtures used at the sports field.

In accordance with the principles of the present invention, there is provided a luminaire having low glare characteristics particularly suited for a sports lighting application. The luminaire includes a high intensity light source disposed within an optical delivery configuration and a housing member having disposed therein, a ballast circuit arrangement which is effective for providing conditioned power to the high intensity light source. The optical delivery configuration includes a reflector member constructed of a non-metallic material and being shaped parabolically so as to include an open end, an apex disposed opposite the open end and a central axis extending therethrough. The high intensity light source of the present invention is a discharge light source having an elongated discharge associated therewith and wherein the elongated discharge light source is disposed within the reflector member in a manner so as to be horizontal and perpendicular to the central axis. Moreover, the light source is disposed within the reflector member in a region near the apex of the reflector so that an essentially oval shaped light pattern is generated. In an important modification of the present invention, louvers are disposed within the reflector member to redirect light output that would otherwise exit the open end of the reflector at a high upper angle relative to the central axis, into a smaller angle so as to be more efficiently combined with the light output of other similar fixtures in an overlapping beam pattern arrangement on the playing surface of the sports field.

BRIEF DESCRIPTION OF THE DRAWINGS

In the following detailed description, reference will be made to the attached drawings in which.

DETAILED DESCRIPTION AND OPERATION

Figure 1:
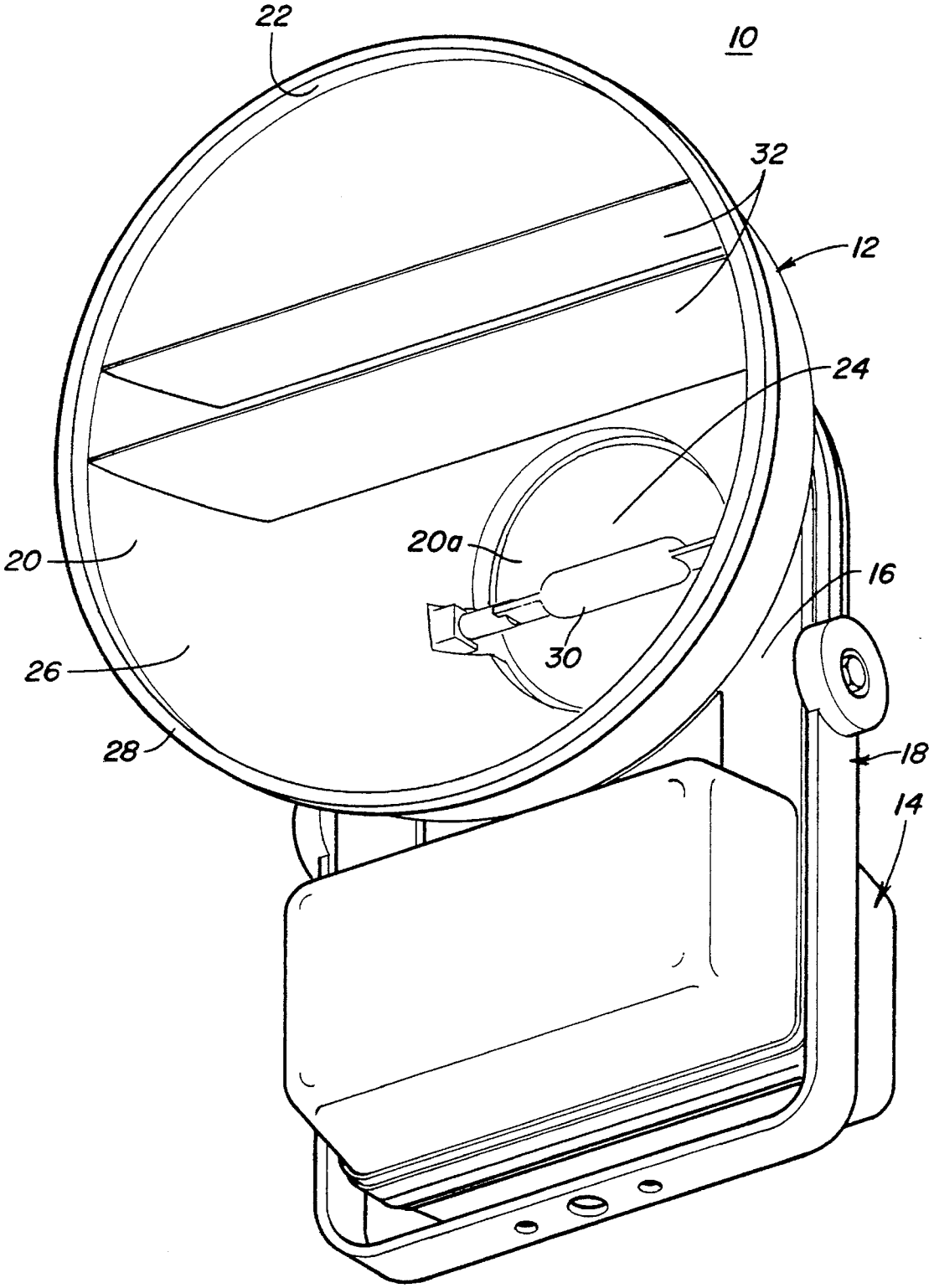
FIG. 1 is an isometric view of a sports lighting luminaire constructed in accordance with the principles of the present invention.

As seen in FIG. 1, the luminaire 10 having improved light delivery characteristics particularly suited for a sports lighting application includes an optical portion shown generally as 12, a ballast and ballast housing portion shown generally as 14 and a support arrangement 16. The support arrangement 16 physically connects the optical portion 12 to the ballast, housing portion 14. Additionally, the support arrangement connects to a mounting configuration 18 which serves the purpose of providing an adjustment means for setting the downward projecting angle of the luminaire 10 as will be described in more detail with reference to FIG. 4. By separating the ballast portion 14 from the optical portion 12, a thermal isolation between such two portions is achieved. It should be recognized however, that the ballast portion 14 and optical portion 12 could be formed using an integral housing arrangement that utilized an alternate thermal isolation arrangement; it is contemplated that such a luminaire would still be covered by the present invention particularly relative to the optical characteristics of the present invention. Additionally, it can be appreciated that the ballast portion could be disposed remotely of the optical portion; for instance, the ballast portion could reside at the bottom of a mast and be electrically cabled to the optical portion of the top of the mast. It is contemplated that both of such configurations would be within the scope of the present invention particularly with respect to the improved photometric properties of the luminaire 10 described herein.

The optical portion 12 includes a reflector member 20 which is constructed of a non-metallic material and is shaped in the form of a parabaloid of revolution. In the present invention, reflector 20 is constructed having a glass substrate material with a dichroic or multi-film interference coating disposed thereon. In this manner, the reflector member 20 can achieve reflectance of approximately 95% of the light generated by the light source as opposed to the 75–85% value typically achieved using an aluminum reflector. With the parabolic configuration of reflector 20, an open end 22 is formed at one end of the parabola, an apex end 24 is formed opposite the open end 22, and a central axis extends therebetween.

It is also possible to provide an alternate reflector arrangement whereby an aluminum, flash coating could be disposed over a glass substrate and a titania and silica coating then disposed thereover. In such a contemplated modification, the reflective properties would still be greater than about 90% whereas the cost would be reduced and the photon emission problem affecting quartz life could be largely avoided. A cover member 26 is fitted over the open end 22 and secured to the reflector member 20 by means of a ring member 28. The cover member 26 is made of tempered glass and is effective for filtering unwanted UV radiation which is given off by the light source 30 disposed within the reflector member 20. As an alternative, the cover member could be made of a molded borosilicate material and still exhibit the no-shattering/spraying characteristic as well as the UV filtering characteristic.

The light source 30 is disposed within the reflector member 20 so as to be in close proximity to the apex end 24 of the reflector 20. The light source 30 of the preferred embodiment is a double ended, high intensity discharge (HID) lamp having a bare arc tube wall made of fused quartz and containing a metal halide fill which is excited to a discharge state thereby producing an elongated arc discharge within the arc tube. The light source 30 is disposed at a juncture point between the main reflector portion 20 and the rear reflector portion 20*a* so that, upon opening the rear reflector portion 20*a*, access can be had to the light source 30 from the rear. Of course, alternate light source arrangements are possible; for instance, a single ended lamp could be utilized as well as a lamp having a low profile outer jacket could be utilized and still provide the elongated arc discharge which, in combination with the described reflector, results in the improved light distribution arrangement of the present invention.

As further seen in FIG. 1, disposed along the upper half of the reflector member 20 is a series of substantially equally spaced apart louver members 32. As will be discussed hereinafter in further detail, the louver members 32 provide a means for redirecting light output that would otherwise exit the open end 22 at a large angle relative to the central axis, into a smaller such angle thereby allowing the lighting designer the ability to reduce glare or spill light from areas above the playing surface of the sports field.

Figure 2:
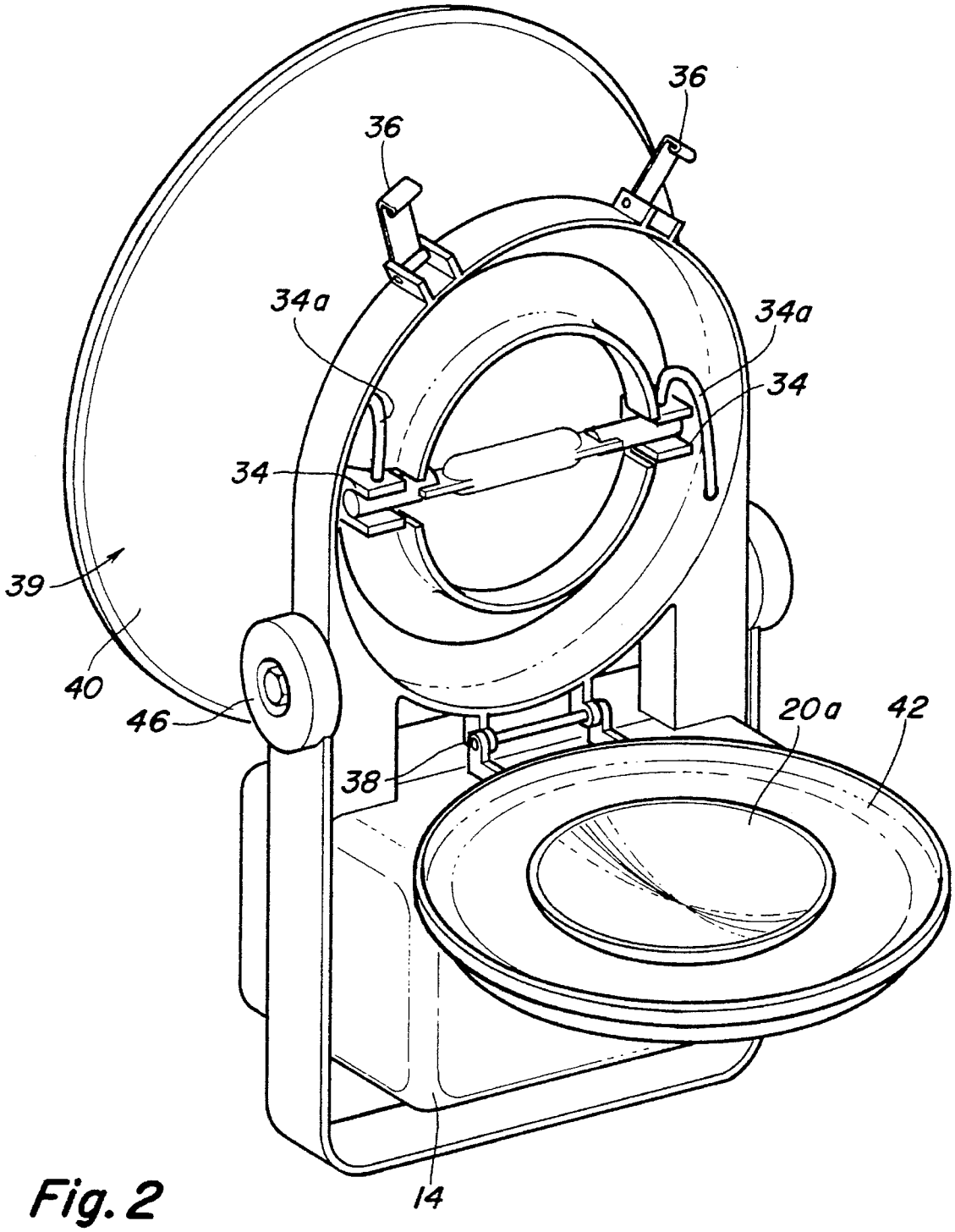
FIG. 2 is a rear elevational view of the sports lighting luminaire of FIG. 1 showing the split reflector feature that allows relamping of the fixture from the rear.
Figure 4:
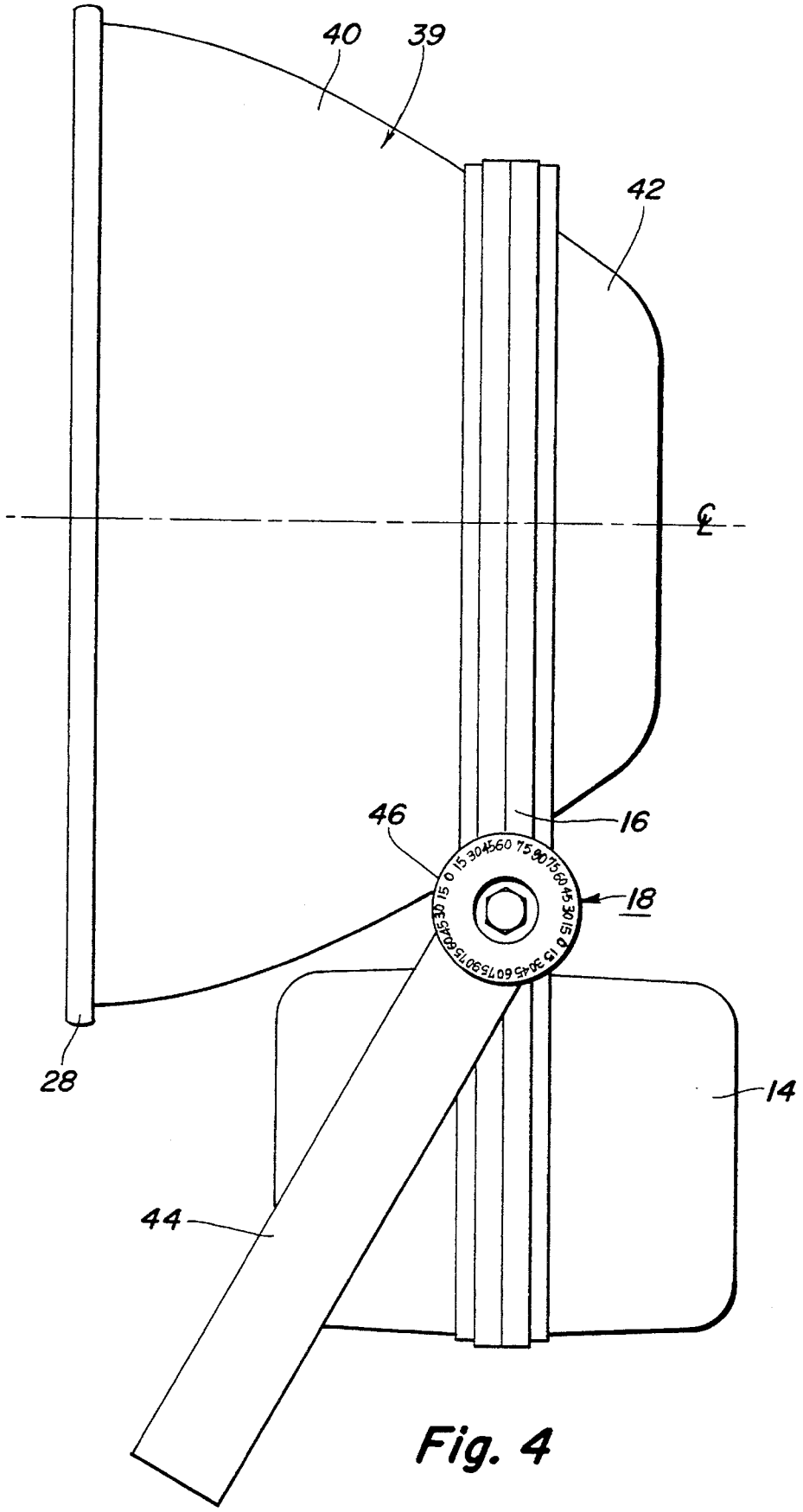
FIG. 4 is a side elevational view of the sports lighting luminaire of FIG. 1 showing the adjustment and mounting arrangement for such luminaire.

The sports lighting luminaire 10 of the present invention is illustrated in FIG. 2 from a rear perspective whereby a protective housing 39 in surrounding relation to the reflector member 20 is shown. The protective housing 39 includes a front cover portion 40 corresponding to the main reflector portion 20 and a rear door portion or rear cover portion 42 corresponding to the rear reflector portion 20*a* (FIG. 4). The rear cover portion 42 includes a hinge member 38 and latching members 36 for opening and closing the rear cover portion respectively. The rear cover portion 42 is shown in the open position so as to allow access to the light source 30. The rear reflector portion 20*a* is mounted on the rear cover portion 42 so that when the rear cover portion 42 is open, the rear reflector portion 20*a* opens downward away from the main reflector portion 20. There can be an insulating sheet portion (not shown) placed between the rear reflector portion 20*a* and the rear cover portion 42 to prevent damage to the rear cover portion 42 by operation of the light source 30 in close proximity thereto. The rear cover portion 42 can be latched into the closed position against the front cover portion 40 thereby protecting the reflector member 20 and the light source 30 from damage. Latching members 36 are provided for this purpose along with hinge member 38 that allows opening of the rear cover portion 42 downward. Of course it can be realized that the placement of the hinge member 38 and the latching members 36 can be modified without departing from the scope of the present invention and it is contemplated that such a modification would be covered by this invention.

As further illustrated in FIG. 2, the light source 30 is electrically coupled into the ballast circuit, ballast housing arrangement 14, by means of conductor arrangement which includes conductor members 34 and conductor leads 34*a*. Of course, it can be understood that an alternate conductor arrangement would have to be provided when a single ended light source is utilized. Slots 44 are cut out of the back opening of the main reflector member 20 to allow for mounting the pinch ends of light source 30 into the conductor members 34 with as little disruption to the parabolic surface of reflector member 20 as possible. Light source 30 is disposed between the conductor members 34 in a manner so as to lie horizontally on a plane which can be envisioned as intersecting the reflector member 20 into equal upper and lower halves of a parabaloid of revolution. Moreover, such orientation of the light source 30 relative to the reflector member 20 is such that the elongated discharge arc of the light source 30 is perpendicular to the central axis of the reflector member 20. In the preferred embodiment of the present invention, the light source 30 is disposed near the apex end 24 of the reflector member 20 at a distance which is proportionate to the length of the arc discharge by a factor of approximately 1:2. That is, the arc discharge is approximately twice the length as the distance between the light source 30 and the apex of the parabolic reflector member 20. This distance relationship is shown in the sectional view of FIG. 3 wherein a ray tracing of light rays output from the light source 30 are illustrated as exiting the open end 22 of the reflector member 22 in a substantially collimated fashion. By disposing the light source 30 at such a rearward position of the reflector member 20 and in the above described orientation which is horizontal in one plane and perpendicular in another plane relative to the reflector member 20, the luminaire 10 of the present invention achieves an essentially oval shaped light pattern as would be measured by conventional photometric measuring techniques. This orientation of the light source 30 relative to the reflector member 20 allows for a very tight control of light output in the vertical plane relative to the horizon and a very loose control of the light output relative to the horizon. Accordingly, light output at high angles relative to the central axis of the reflector member 20 are minimized thereby allowing for a simpler louvering operation to redirect the upward directed light output into a downward direction away from the eyes of spectators or possible other areas sensitive to glare light. It should be understood that variations to the above-stated ratio can be utilized and still achieve the desired oval light output pattern; it is contemplated that such variations are within the scope of the present invention.

In meeting the lighting requirements of a sports field application, the lighting designer must mount groups of the subject sports lighting luminaires on mast structures that are above and at the outer periphery of the sports field playing surface. As such, it is necessary to adjust the tilt of each of such light fixtures so as to achieve the optimum combination of light output patterns at the playing surface. This optimization of the number and location of light fixtures includes consideration of energy costs, that is, by reducing the number of such fixtures, electricity costs can be reduced, minimizing the exposure of such groups of light fixtures to wind shear conditions, and, achieving the most uniform overlapping light patterns at the playing field surface. To this end, the sports lighting luminaire 10 of the present invention provides an oval light output pattern which, when projected outward and downward onto a playing surface, results in an essentially circular pattern at the playing field surface. Moreover, with the circular pattern at the playing field surface, the highest intensity portion of the individual light pattern is at the center of the circular pattern with uniformly diminishing intensities along the rays of such circular pattern. In this manner, when an adjacent output light pattern is overlapped with the first such pattern, the overlapped portions can be more predictably combined to provide a uniform overall pattern.

As seen in FIG. 4, the sports lighting luminaire 10 includes the mounting arrangement 18 which is adjustably coupled to the support arrangement 16 so as to allow precise angling of the optical portion 12 relative to the playing field surface. To this end, the mounting arrangement includes a mounting trunion 44 which is essentially U-shaped and extends from one side of the support arrangement 16 to the other. The mounting bar 44 connects to the support arrangement through a rotatable pivot joint 46 having a number of markings disposed along the outer periphery thereof thus allowing for setting the angle of tilt for the sports lighting luminaire 10.

Figure 3:
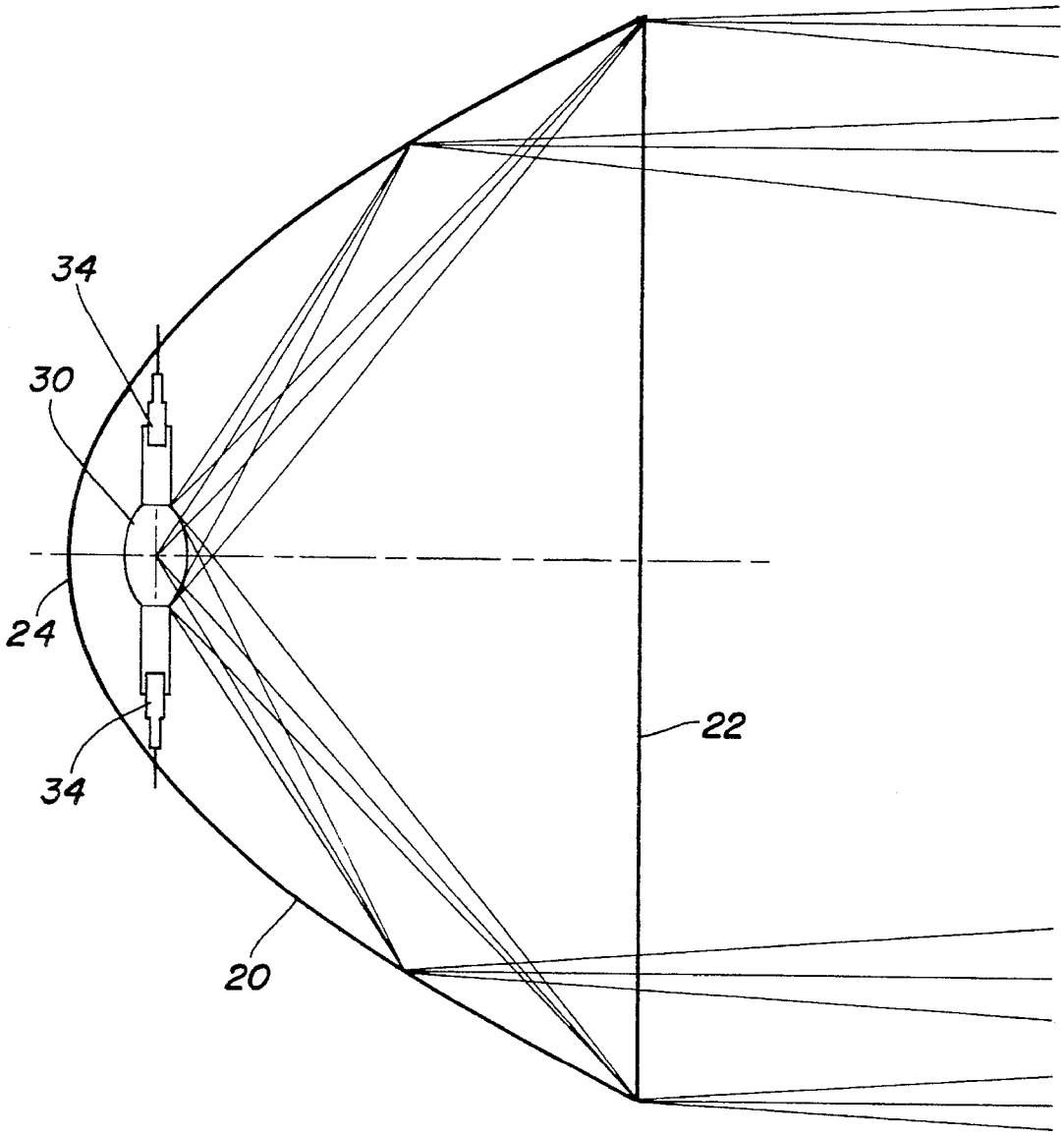
FIG. 3 is a top elevational view in section of the sports lighting luminaire of FIG. 1 showing a ray tracing indicating light output therefrom.
Figure 5A:
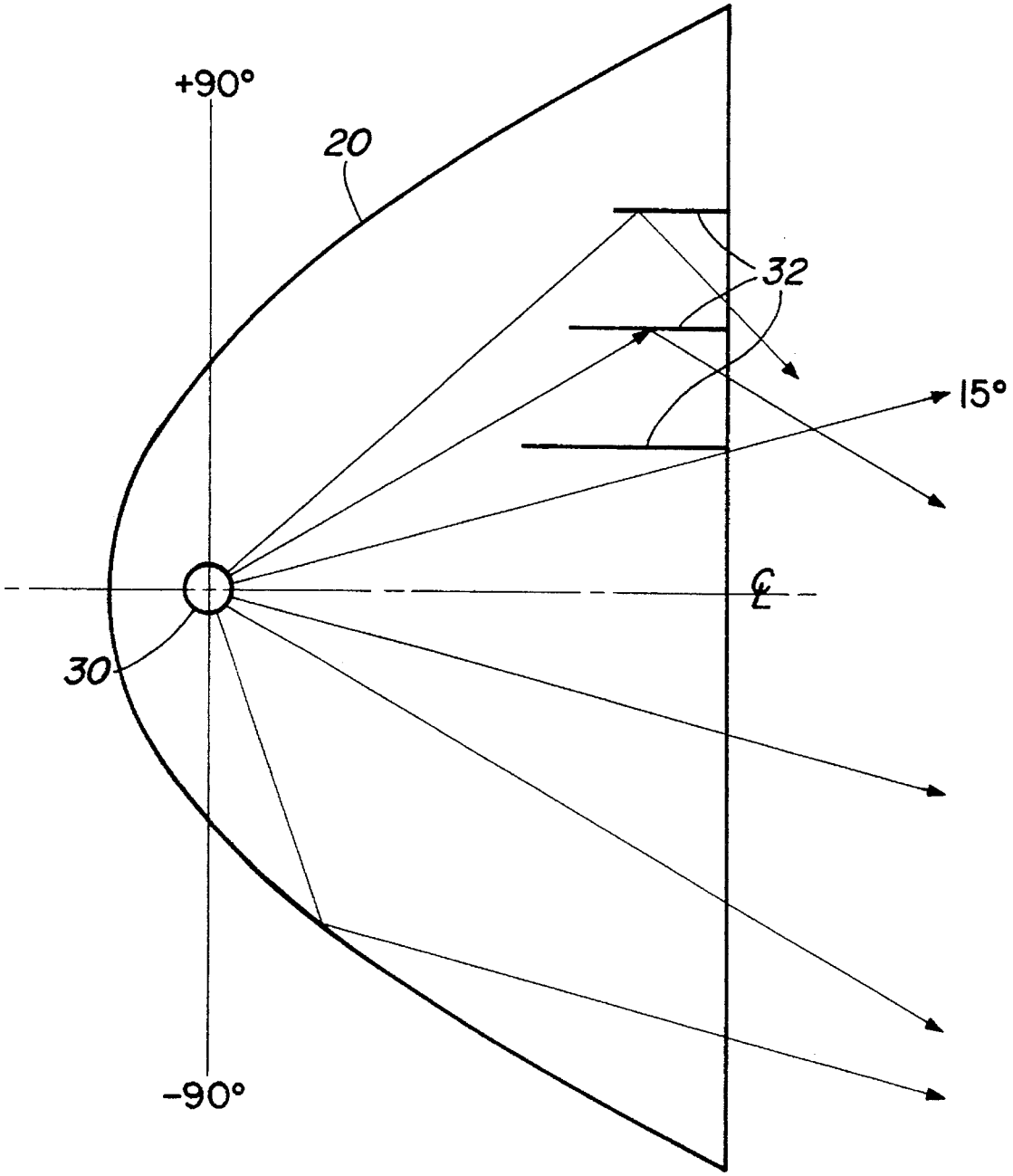
FIGS. 5A and 5B are respectively, a side sectional view of the sports lighting luminaire of FIG. 1 and a graphical representation of the light intensity distribution relative to light output angle of the sports lighting luminaire of FIG. 1.
Figure 5B:
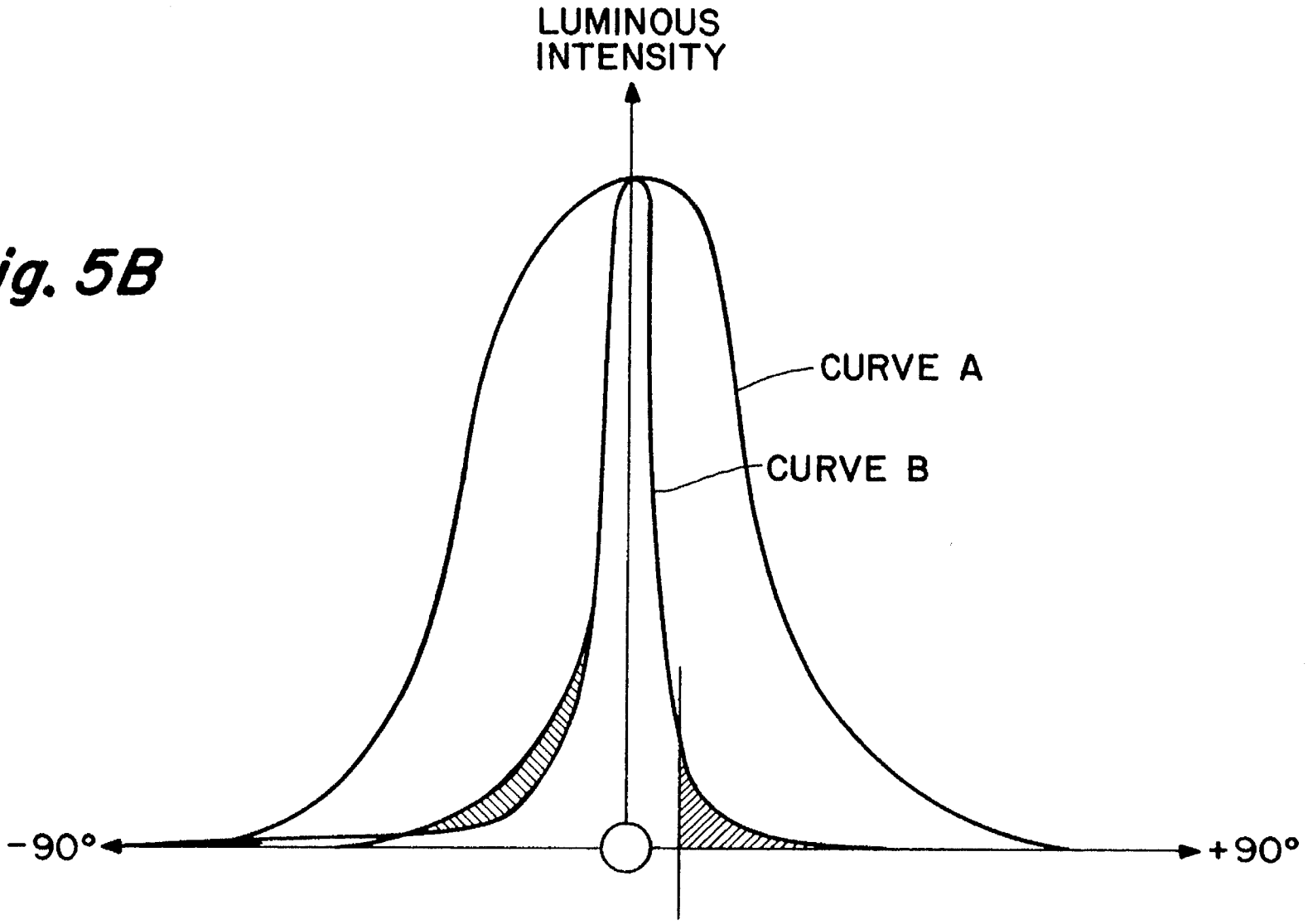

FIGS. 5A and 5B illustrate the optical performance characteristics of the sports lighting luminaire 10 particularly with respect to the control of light output in the vertical plane. Similar to the illustration of the ray tracing in FIG. 3 showing light output in the horizontal plane, FIG. 5A shows light output in the vertical plane and, with the use of louver members 32, shows that light output approaching 15 degrees relative to horizon, is redirected into lower angles and even angles below horizon. In a sports lighting application, light output redirected from high angles relative to the horizon to angles below the horizon serves the purpose of taking light that would otherwise spill into the spectator region of the sports field or even beyond the sports field, and redirecting such wasted light onto the playing surface where it can be more efficiently utilized.

As illustrated in FIG. 5B, the photometric data for the sports lighting luminaire 10 of the present invention, shows two distinctly different curves designated curve A for the horizontal light output and curve B for the vertical light output. By this illustration, it can be seen that for light output along the horizontal plane as illustrated by the ray tracing of FIG. 3, there is looser control of such output and more of such output is transmitted at larger angles. For light output along the vertical plane, a greater control results in such light output occurring at smaller angles. Moreover, as seen by the shaded area in the positive angle region on Curve B, by the use of louvers 32, this higher angle light output is redirected to the lower angle portion of Curve B as shown by the hatched area shown in the negative angle region of Curve B. The practical effect of such a light output control arrangement achieved by the sports lighting luminaire 10 is to provide an oval shaped light output at the open end 22 of the reflector member 20 as previously discussed.

Although the hereinabove described embodiment of the invention constitutes the preferred embodiment, it should be understood that modifications can be made thereto without departing from the scope of the invention as set forth in the appended claims. For instance, although the preferred embodiment illustrates the use of a non-metallic reflector member because of its higher reflectance properties, the benefits of the present invention with respect to the orientation of the light source relative to a parabolically shaped reflector to achieve an oval shaped light output pattern could be equally beneficial with the use of an aluminum reflector and it is contemplated that such a modification would be within the scope of the present invention.

We claim:

1. A light fixture having improved light delivery characteristics particularly suited for sports lighting applications, said light fixture comprising:

a high intensity light source;

means for powering the light source;

an optical delivery arrangement including a reflector member which is shaped in a substantially parabolic manner so as to include an open end, an apex formed opposite said open end, and a central axis extending therethrough;

wherein said light source is an arc discharge light source having an elongated arc discharge associated therewith, said light source disposed within said reflector in an orientation that is horizontal and perpendicular to the central axis, said light source is disposed within said reflector proximate said apex of said reflector so that said light source is in a position effective for generating a light pattern in a manner whereby light output along on plane is tightly controlled so as to result in an essentially collimated beam along said plane; and, wherein said reflector member is made up of a first main portion on which said open end is formed and a second rear portion on which said apex is formed, said first and second portions being joined in a closed position to form a substantially uniform reflective surface on the interior of said reflector member and, said first and second portions having a separation formed therebetween so that, when in an open condition, a space between said first and second portions is accessible.

2. The light fixture as set forth in claim 1 wherein said light source is a double ended high intensity discharge lamp which is disposed at a distance from said apex of said reflector member proportionate to the length of said elongated arc discharge by a factor of approximately 1:2.

3. The light fixture as set forth in claim 1 wherein said reflector member is constructed of a substrate having a non-metallic composition and having disposed thereon, a multi-film interference coating thereby providing reflectance properties of greater than 90%.

4. The light fixture as set forth in claim 1 wherein said light source is a high intensity discharge lamp having at least one end with leads extending therefrom that are electrically connected to at least one conductor member disposed along said separation between said first and second portions of said reflector member such that, when an open condition exists between said first and second portions, said lamp is accessible thereby.

5. The light fixture as set forth in claim 1 further comprising a cover disposed over said open end of said reflector member and being effective so that UV radiation given off by said light source is filtered thereby and substantially prevented from exiting said light fixture.

6. The light fixture as set forth in claim 5 wherein said cover is constructed of tempered glass.

7. The light fixture as set forth in claim 1 further comprising at least one louver member which is disposed within said reflector member in a region above a plane formed horizontally along said central axis.

8. The light fixture as set forth in claim 1 further comprising a housing member in which said powering means is disposed, said housing member being separated from said optical delivery arrangement by a support member thereby achieving substantial thermal insulation between said powering means and said optical delivery arrangement.

9. The light fixture as set forth in claim 1, further comprising a protective housing disposed in surrounding relation to said reflector member, said protective housing having a front cover portion corresponding to said first main portion of said reflector member and a rear door portion corresponding to said second rear portion of said reflector member, said rear door portion of said protective housing having a hinge and latch arrangement for opening said rear door portion and locking said rear door portion respectively.

10. A sports lighting fixture operable in conjunction with other similar sports lighting fixtures for uniformly and efficiently illuminating the playing surface of a sports field, said sports lighting fixture comprising:

a high intensity discharge lamp having an elongated arc discharge associated therewith;

means for supplying energy to said lamp;

a reflector member having an open end, an apex and a central axis associated therewith;

wherein said lamp is disposed within said reflector in an orientation which is horizontal and perpendicular to said central axis of said reflector and proximate said apex so that said lamp is in a position effective for generating an oval shaped light pattern;

mounting means for mounting said reflector, said mounting means including an adjusting means for adjusting the angle of said sports lighting fixture relative to the playing surface so that said oval shaped light pattern is translated to an essentially circular shaped light pattern at the playing surface; and, at least one louver member disposed within said reflector member in a region above a plane formed horizontally along said central axis.

11. The sports lighting fixture as set forth in claim 10 wherein said light source is a high intensity discharge lamp which is disposed at a distance from said apex of said reflector member proportionate to the length of said elongated arc discharge by a factor of approximately 1:2.

12. The sports lighting fixture as set forth in claim 10 wherein said reflector member is constructed of a substrate having a non-metallic composition and having disposed thereon, a dichroic coating thereby providing reflectance properties of greater than 90%.

13. The sports lighting fixture as set forth in claim 10 wherein said reflector member is made up of a first main portion on which said open end is formed and a second rear portion on which said apex is formed, said first and second portions being joined in a closed position to form a substantially uniform reflective surface on the interior of said reflector member and, said first and second portions having a separation formed therebetween so that, when in an open condition, a space between said first and second portions is manually accessible.

14. The sports lighting fixture as set forth in claim 11 wherein further comprising a cover disposed over said open end of said reflector member and being effective so that at least a portion of UV radiation given off by said light source is filtered thereby and prevented from exiting said light fixture.

15. The light fixture as set forth in claim 1, wherein said light source is in a position effective for minimizing high angle light output relative to said central axis in a vertical plane.

16. The light fixture as set forth in claim 10, wherein said light source is in a position effective for minimizing high angle light output relative to said central axis in a vertical plane.

17. The light fixture as set forth in claim 1, wherein substantially all light output of said light fixture exits said open end of said reflector.

18. The light fixture as set forth in claim 10, wherein substantially all light output of said light fixture exits said open end of said reflector.

19. A light fixture having improved light delivery characteristics particularly suited for sports lighting applications, said light fixture comprising:

a high intensity light source;

means for powering the light source;

an optical delivery arrangement including a reflector member which is shaped in a substantially parabolic manner so as to include an open end, an apex formed opposite said open end, and a central axis extending therethrough;

wherein said light source is an arc discharge light source having an elongated arc discharge associated therewith, said light source disposed within said reflector in an orientation that is horizontal and perpendicular to the central axis, said light source is disposed within said reflector proximate said apex of said reflector so that said light source is in a position effective for generating a light pattern in a manner whereby light output along on plane is tightly controlled so as to result in an essentially collimated beam along said plane; and, wherein said light source is double ended and is disposed at a distance from said apex of said reflector member proportionate to the elongated arc discharge by a factor of approximately 1:2.

* * * * *